US007232380B2

(12) United States Patent
Nakahara

(10) Patent No.: US 7,232,380 B2
(45) Date of Patent: Jun. 19, 2007

(54) GOLF CLUB HEAD

(75) Inventor: Norihiko Nakahara, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 310 days.

(21) Appl. No.: 10/956,185

(22) Filed: Oct. 4, 2004

(65) Prior Publication Data

US 2005/0130766 A1 Jun. 16, 2005

(30) Foreign Application Priority Data

Oct. 3, 2003 (JP) ..... 2003-345427

(51) Int. Cl.
*A63B 53/04* (2006.01)

(52) U.S. Cl. ..... 473/324; 473/335; 473/342; 473/349; 473/350

(58) Field of Classification Search ..... 473/324–350, 473/290–291
See application file for complete search history.

(56) References Cited

U.S. PATENT DOCUMENTS 3,995,865 A * 12/1976 Cochran et al. ..... 473/337
5,193,805 A * 3/1993 Solheim ..... 473/291
6,554,722 B2 * 4/2003 Erickson et al. ..... 473/334
6,685,577 B1 * 2/2004 Scruggs et al. ..... 473/349
2001/0055996 A1 * 12/2001 Iwata et al. ..... 473/350
2003/0228928 A1 * 12/2003 Yabu ..... 473/290

FOREIGN PATENT DOCUMENTS

JP 2002-035182 2/2002
JP 2002-065912 3/2005

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

A golf club head has a ratio of a head mass to a head volume equal to or grater than 3 g/cm$^2$, and a face portion that includes an impact surface is configured by a member made from an aluminum alloy having a maximum tensile strength equal to or greater than 600 MPa. The aluminum alloy is made by using a rapid quenching method. The golf club head can improve the carry distance and the flight direction characteristics of a hit golf ball compared with a conventional golf club head.

6 Claims, 2 Drawing Sheets

GOLF CLUB HEAD

BACKGROUND OF THE INVENTION

1. Field of the Invention

The present invention relates to an iron golf club head. More specifically, the present invention relates to a solid golf club head having no hollow regions in a golf club head main body, or to a golf club head having a hollow region in a portion thereof.

2. Description of the Related Art

Conventionally, iron golf clubs use a titanium alloy (specific gravity substantially equal to 4.5), for example, in a face that impacts a golf ball, thus achieving a lighter weight face. On the other hand, however, by placing a metallic heavy member having high specific gravity in a desired location as a weight chip (adjusting member) adjusting for a center of gravity of the golf club head, the moment of inertia of a golf club head may increase, or the center of gravity of the golf club head may be lowered. The carry distance of the struck golf ball thus increases, or the flight direction characteristics of the struck golf ball improve. Further, the depth of the center of gravity of the golf club head can be changed so as to shift the center of gravity away from the impact surface. However, methods of disposing the weight chip adjusting for the center of gravity in a desired position do not go beyond adjusting methods that make minute adjustments to the center of gravity position, or adjusting methods that make minute adjustments in the moment of inertia. There are limitations on how much the position of the center of gravity such as the height or the depth of the center of gravity can be changed, and there are limitations on how much the moment of inertia can be increased.

On the other hand, when lightening the overall golf club head by using, in an impact surface, an aluminum alloy having a smaller specific gravity than that of a titanium alloy (aluminum alloy specific gravity substantially equal to 2.5), the amount that the golf club head is lightened may be allocated to the adjusting weight chip, thus increasing the degree of freedom in performing using the adjusting weight chip for the center of gravity. However, the physical strength (maximum tensile strength) of the aluminum alloy is low when 7075 aluminum alloy, for example, is used. Consequently, the thickness of a member made from this alloy must be made thicker when used as a face member that forms the impact surface. Accordingly, the advantages of low specific gravity aluminum alloys cannot be utilized effectively due to the amount that the thickness of the face member increases, and there is a limit in how much the center of gravity position and the moment of inertia of the golf club head can be changed.

JP 2002-35182 A and JP 2002-65912 A disclose an iron golf club head whose impact surface (face) that impacts a golf ball is configured by using a member made from an aluminum alloy in which fine, hard particles or silicon carbide are or is dispersed. However, the member used here increases the spin of the golf ball, and the physical strength of the aluminum alloy is similar to that of conventional aluminum alloys. Consequently, the face member must be made thicker, and the center of gravity position and the moment of inertia continue to be similar to their conventional values. The carry distance and the flight direction characteristics of a struck golf ball thus cannot be improved compared to their conventional results by using the weight chip adjusting for the center of gravity of the golf club head.

SUMMARY OF THE INVENTION

The present invention is made in order to solve problems like those described above. An object of the present invention is to provide a golf club head that is capable of improving the carry distance of a struck golf ball, and is capable of improving the flight direction characteristics of a struck golf ball, compared to a conventional golf club head.

To attain the above object, according to the present invention, there is provided a golf club head including: a face portion including an impact surface that impacts a golf ball; and a hosel portion into which a golf club shaft is inserted and fixed; wherein a ratio of a head mass of the golf club head to a head volume of the golf club head is equal to or greater than 3 g/cm$^3$; and wherein the face portion including the impact surface is configured by using a member made from an aluminum alloy having a maximum tensile strength equal to or greater than 600 MPa.

In the golf club head, it is preferable that the aluminum alloy be made by using a rapid quenching method. Further, in the golf club head, in addition to the face portion, the hosel portion is also configured by using the member, for example.

Further, in the golf club head, it is preferable that, when the golf club head is placed on a horizontal plane so as to achieve a specified loft angle, a moment of inertia about a vertical line that passes through a center of gravity of the golf club head and is orthogonal to the horizontal plane is equal to or greater than 2,000 g·cm$^2$.

Further, it is preferable that a center of gravity height of the golf club head be less than 23 mm.

Further, it is preferable that a center of gravity position of a golf club head be set back from a leading edge of the impact surface by a distance equal to or greater than 2 mm in a direction opposite to an golf ball impact direction.

Further, in the golf club head, it is preferable that an adjusting member made from a high specific gravity metal having a specific gravity equal to or greater than 8 is bonded to the golf club head. It is more preferable that the specific gravity be equal to or greater than 8 and equal to or less than 19.

The golf club head of the present invention has a ratio of the mass of the golf club head to the volume of the golf club head equal to or greater than 3 g/cm$^3$. In addition, the face portion having the impact surface is structured by a member made from an aluminum alloy having a maximum tensile strength equal to or greater than 600 MPa. The mass of the member can thus be made lower than that of a conventional member. The amount that the mass of the golf club head thus decreases can be more greatly apportioned to an adjusting member such as a weight chip adjusting for a center of gravity of the golf club head compared to a conventional golf club head. The center of gravity position and a desired moment of inertia can thus be adjusted. As a result, improvement in the golf ball carry distance and improvements in flight direction characteristics of the golf ball can be achieved.

DETAILED DESCRIPTION OF THE PREFERRED EMBODIMENTS

A golf club head of the present invention is explained in detail below based on preferred embodiments shown in the appended drawings.

Figure 1A:
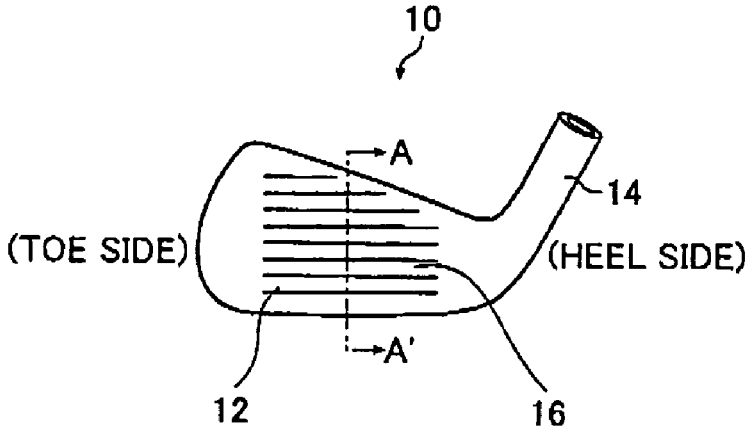
FIG. 1A is a front view of a golf club head according to one embodiment of the present invention.
Figure 1B:
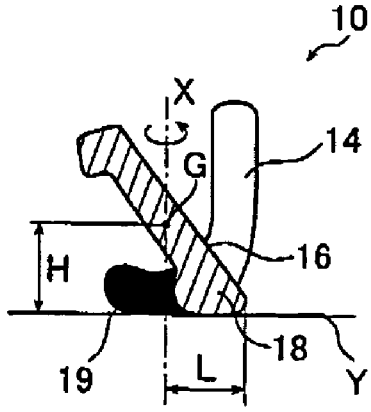
FIG. 1B is a cross sectional view of the golf club head shown in FIG. 1A as seen from the direction of arrows A–A'.

FIG. 1A is a front view of a golf club head according to one embodiment of the present invention, and FIG. 1B is a cross sectional view of the golf club head shown in FIG. 1A as seen from the direction of arrows A–A'.

A golf club head 10 is an iron golf club head, in which a golf club head main body portion 12 is formed integrally with a hosel portion 14 into which a golf club shaft is inserted for bonding the shaft to the golf club head main portion 12.

A ratio of the head mass of the golf club head 10 to the head volume of the golf club head 10 is equal to or greater than 3 g/cm$^3$. The hosel portion 14 and a face portion 18 that includes an impact surface 16 is configured by a member made from a high strength aluminum alloy having a maximum tensile strength equal to or greater than 600 MPa.

The high strength aluminum alloy can be obtained by a rapid quenching method in which the molten alloy is rapidly solidified. Specifically, by rapidly quenching a melted metal containing Al as its main element and containing predetermined additive elements, an amorphous phase, a mixed amorphous and microcrystalline phase, or a microcrystalline phase can be obtained by regulating the quenching. The resulting alloy has high strength and superplasticity. For example, a rapidly quenched powder may be made from a molten metal by using a gas atomizing method. The powder may then be extruded and solidified, thus manufacturing a member such as a plate material. An alloy such as that having the composition prescribed in JP 3205495 B. for example, may be used as the alloy. Further, MESO-10 (Al-9.5Zn-3Mg-1.5Cu-0.04Ag), which is manufactured by Nippon Light Metal Company, Ltd.

Referring to FIG. 1B, an adjusting weight chip (a black color region in FIG. 1B) 19 for a center of gravity of the golf club head, the chip made from a tungsten alloy having a specific gravity equal to or greater than 8 is bonded to a sole portion of a golf club head main body portion 12, thus regulating the moment of inertia and the center of gravity position of the golf club head.

The moment of inertia here is, specifically, the moment of inertia about a vertical line X (refer to FIG. 1B) that is orthogonal to a horizontal plane Y (refer to FIG. 1B) and passes through a center of gravity G of the golf club head 10 when the golf club head 10 is placed on the horizontal plane Y so as to achieve a specified loft angle. The moment of inertia is then regulated to be equal to or greater than 2,000 g·cm$^2$ by using the adjusting weight chip 19. The moment of inertia discussed here is the moment of inertia when an impact surface 16 rotates toward a toe side or a heel side. By prescribing the moment of inertia, dispersions in the ball flight direction decrease, as described hereinafter.

Further, the height of the center of gravity of the golf club head 10 is a height H from a horizontal plane Y of a specific gravity G, and the height H is adjusted to be less than 23 mm. In addition, a depth L of the center of gravity of the golf club head 10 is set back in a direction behind impact by a distance equal to or greater than 2 mm from a leading edge of the impact surface 16. The set back distance is called the depth L of the center of gravity.

As for adjusting the center of gravity position (the center of gravity height H and the center of gravity depth L) and the moment of inertia, the golf club head main body portion 12, which includes the impact surface 16, is configured by a high strength aluminum alloy having a maximum tensile strength equal to or greater than 600 MPa. Consequently, the thickness of a face portion can be made thinner than that of a conventional golf club head using 7075 aluminum alloy. For example, the thickness can be set from 2.5 to 3.5 mm, and the mass of the golf club head main body portion 12 can be decreased. Accordingly, the mass of the adjusting weight chip 19 made from high specific gravity metals such as tungsten alloys for adjusting the center of gravity of the golf club head can be increased compared to adjusting weight chips of the manufactured golf club heads having equivalent mass as conventional golf club heads. Therefore, the position of the center of gravity (the center of gravity depth L and the center of mass height H) can be adjusted and the moment of inertia can be greatly regulated by the adjusting weight chip 19.

Figure 2A:
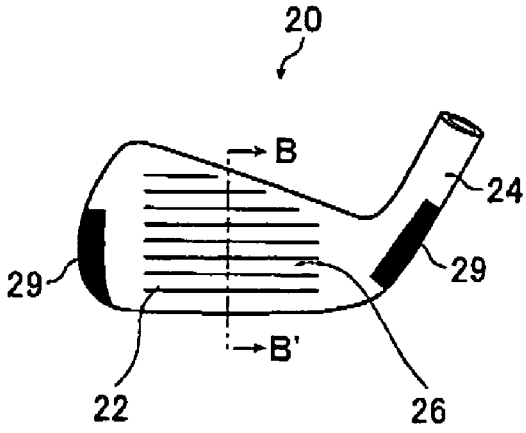
FIG. 2A is a front view of a golf club head according to another embodiment of the present invention.
Figure 2B:
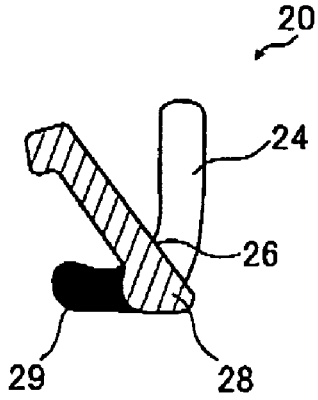
FIG. 2B is a cross sectional view of the golf club head shown in FIG. 2A as seen from the direction of arrows B–B'.

FIG. 2A is a front view of a golf club head according to another embodiment of the present invention, and FIG. 2B is a cross sectional view of the golf club head shown in FIG. 2A as seen from the direction of arrows B–B'.

A golf club head 20 is, like the golf club head 10, an iron golf club head, in which a golf club head main body portion 22 is formed integrally with a hosel portion 24 into which a golf club shaft is inserted for bonding the shaft to the golf club head main portion 22. A ratio of the head mass of the golf club head 20 to the head volume of the golf club head 20 is equal to or greater than 3 g/cm$^3$. The hosel portion 24 and a face portion 28 that includes an impact surface 26 is configured by a member made from a high strength aluminum alloy as described above having a maximum tensile strength equal to or greater than 600 MPa.

Differing from the golf club head 10, a adjusting weight chip 29 that is configured by a tungsten alloy is also bonded to a toe side and a heel side of the golf club head main body portion 22 in addition to the sole portion of the golf club head main body portion 22. The golf club head 20 can be given a lower center of gravity, its center of gravity depth can be increased, and its moment of inertia can be increased.

Figure 3A:
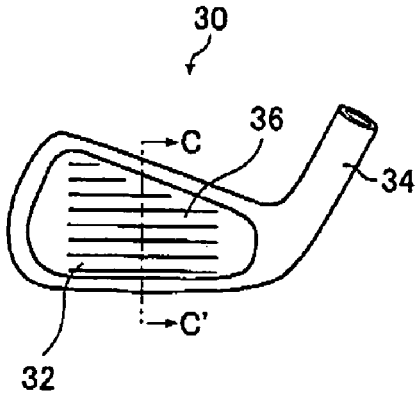
FIG. 3A is a front view of a golf club head according to yet another embodiment of the present invention.
Figure 3B:
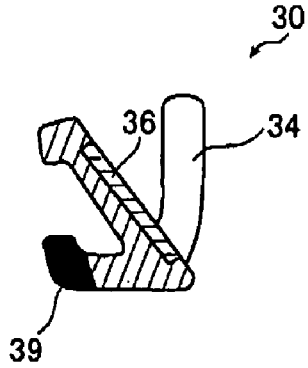
FIG. 3B is a cross sectional view of the golf club head shown in FIG. 3A as seen from the direction of arrows C–C'.

FIG. 3A is a front view of a golf club head according to yet another embodiment of the present invention, and FIG. 3B is a cross sectional view of the golf club head shown in FIG. 3A as seen from the direction of arrows C–C'.

A golf club head 30 is an iron golf club head, in which a golf club head main body portion 32 is formed integrally with a hosel portion 34 into which a golf club shaft is inserted for bonding the shaft to the golf club head main portion 32. A face member 36 that includes an impact surface is joined to the golf club head main body portion 32.

A ratio of the head mass of the golf club head 30 to the head volume of the golf club head 30 is equal to or greater than 3 g/cm$^3$. The face member 36 is configured by a member made from a high strength aluminum alloy as described above having a maximum tensile strength equal to or greater than 600 MPa. On the other hand, the golf club head main body portion 32 and the hosel portion 34 are configured by a member made from a stainless steel alloy having a specific gravity of 7.8 (gray color regions in FIGS. 3A and 3B). An adjusting weight chip 39 for a center of gravity configured by a tungsten alloy is bonded to a sole portion of the golf club head main body portion 32. The golf club head 30 can thus be given a lower center of gravity, its center of gravity depth can be increased, and shown in FIG. 5A as seen from the direction of arrows E–E'.

Figure 4A:
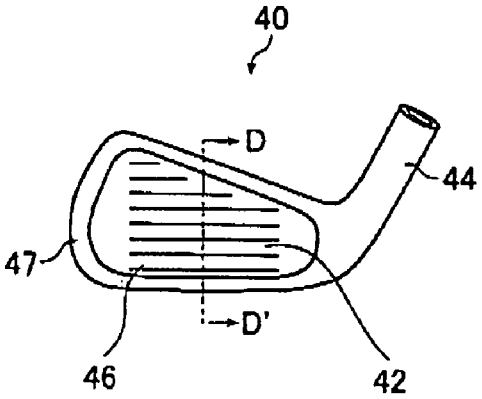
FIG. 4A is a front view of a golf club head according to a further embodiment of the present invention.
Figure 4B:
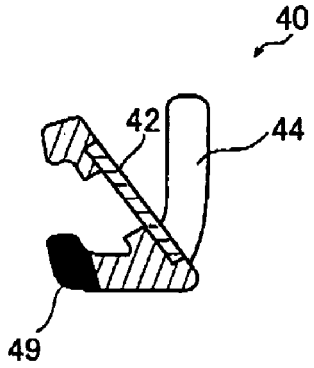
FIG. 4B is a cross sectional view of the golf club head shown in FIG. 4A as seen from the direction of arrows D–D'.

FIG. 4A is a front view of a golf club head according to a further embodiment of the present invention, and FIG. 4B is a cross sectional view of the golf club head shown in FIG. 4A as seen from the direction of arrows D–D'.

The golf club head 40 is an iron golf club head and includes a golf club head main body portion 46, in which an impact surface 42 that impacts a golf ball is integrally formed with a hosel portion 44 into which a golf club shaft is inserted for bonding the shaft to the golf club head main body portion 46. A member 47 is provided to the golf club head main body portion 46 to surround the impact surface 42. A rear surface of the impact surface 42 is exposed as a rear surface of the golf club head 40.

The hosel portion 44 and the member 47 are configured by stainless steel members. Further, a tungsten alloy adjusting weight chip 49 is bonded to a sole portion formed by the member 47 in the golf club head 40. The golf club head 40 can thus be given a lower center of gravity, the center of gravity depth can be increased, and the moment of inertia can be increased.

Figure 5A:
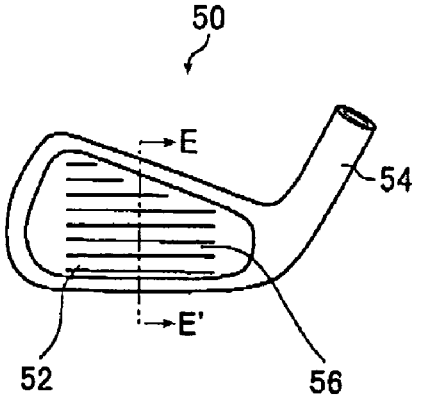
FIG. 5A is a front view of a golf club head according to a still further embodiment of the present invention.
Figure 5B:
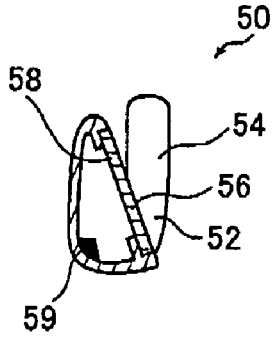
FIG. 5B is a cross sectional view of the golf club head shown in FIG. 5A as seen from the direction of arrows E–E'.

FIG. 5A is a front view of a golf club head according to a still further embodiment of the present invention, and FIG. 5B is a cross sectional view of the golf club head shown in FIG. 5A as seen from the direction of arrows E–E'.

A golf club head 50 is an iron golf club head and includes a golf club head main body portion 52 and a hosel portion 54 into which a golf club shaft is inserted for bonding the shaft to the golf club head main portion 52. The golf club head main body portion 52 and the hosel portion 54 are formed integrally with each other. A face member 58 having an impact surface 56 is provided to the golf club head main body portion 52. A hollow region is formed in the golf club head 50 by joining the face member 58 to the golf club head main body portion 52. A ratio of the head mass of the golf club head 50 to the head volume of the golf club head 50 is limited to a value equal to or greater than 3 g/cm$^3$. The face member 58 that includes the impact surface 56 is configured by a member made from a high strength aluminum alloy as described above having a maximum tensile strength equal to or greater than 600 MPa. On the other hand, the golf club head main body portion 52 is configured by a stainless steel material having a specific gravity of 7.8. An adjusting weight chip 59 configured by a tungsten alloy is provided within the hollow region, bonded to the golf club head main body portion 52. The golf club head 50 can thus be given a lower center of gravity, its center of gravity depth can be increased, and its moment of inertia can be increased.

The golf club heads 10 to 50 thus achieve a ratio of the head mass of the golf club head to the head volume of the golf club head equal to or greater than 3 g/cm$^3$. In addition, the face portion that includes the impact surface is configured by a member made from an aluminum alloy having a maximum tensile strength equal to or greater than 600 MPa. As will be understood from the embodiments described below, the golf club heads 10 to 50 can improve the carry distance of a hit golf ball and the flight direction characteristics of the hit golf ball compared to those of a conventional golf club head. In addition, the feeling of the golf club head at impact is also improved.

The ratio of the head mass of the golf club head to the head volume of the golf club head is preferably from 3 to 13 g/cm$^3$ in the golf club heads of the present invention. In addition, it is preferable that the face portion, which includes the impact surface, be configured by a member made from an aluminum alloy having a maximum tensile strength from 600 to 1000 MPa. Further, it is preferable that the moment of inertia about a vertical line through the center of gravity of the golf club head and orthogonal to a horizontal plane be from 2,000 to 4,000 g·cm$^2$ when the golf club head is placed on the horizontal plane so as to achieve a specified loft angle. Furthermore, it is preferable that the height of the center of gravity of the golf club head be equal to or greater than 10 mm and less than 23 mm. It is also preferable that the position of the center of gravity of the golf club head be set back from the leading edge of the impact surface by 2 to 18 mm in a direction behind impact. Further, it is preferable that the specific gravity of the high specific gravity metal used in the adjusting member be from 8 to 19.

EXAMPLES

Fourteen types (numbers 1 to 14) of an iron golf club head having a loft angle of 26° were made. Golf clubs were assembled by mounting the golf club heads to identical golf club shafts. The golf clubs were then used to impact golf balls actually, and the feel of the golf club at impact, the carry distance, and the flight direction characteristics of the hit golf balls were investigated.

Configurations of the golf club heads of the present invention that were investigated can be characterized as follows:

(A) A ratio of the head mass to the head volume was set equal to or greater than 3 g/cm$^3$, and the face portion including the impact surface was configured by an aluminum alloy having a maximum tensile strength equal to or greater than 600 MPa;

(B) The aluminum alloy is made by employing a rapid solidification method;

(C) The hosel portion was configured by a member made from an aluminum alloy having a maximum tensile strength equal to or greater than 600 MPa;

(D) The moment of inertia about a vertical line that passes through the center of gravity of the golf club head and orthogonal to a horizontal plane was equal to or greater than 2,000 g·cm$^2$;

(E) The center of gravity height of the golf club head was less than 23 mm;

(F) The center of gravity position of the golf club head was set back from the leading edge of the impact surface by a distance equal to or greater than 2 mm in a direction behind impact; and (G) An adjusting member made from a high specific gravity metal having a specific gravity equal to or greater than 8 was bonded to the golf club head.

Numbers 1 through 7 from among the 14 golf club heads made were golf club heads of the present invention. Numbers 1 and 2 satisfied (A), (B), (D), (E), (F), and (G) described above, while number 3 satisfied (A) through (G).

Further, number 4 satisfied (A), (B), (E), (F), and (G), while number 5 satisfied (A), (F), and (G). Number 6 satisfied (A), (B), and (G), and number 7 satisfied (A) and (B).

Numbers 8 through 14, on the other hand, were not golf club heads of the present invention and at least did not satisfy (A). Numbers 8 through 12 were golf club heads that used 7075 aluminum alloy in the face portions thereof like the conventional golf club heads. Number 13 used a high strength aluminum alloy in the face portion thereof, but the golf club head had a ratio of the golf club head mass to the golf club head volume of less than 3 g/cm$^3$. Number 14 was a golf club head configured by a conventional stainless steel material.

The configurations of numbers 1 to 14 are shown in Table 1 below. The center portion of the impact surface can be made thinner for numbers 1 through 7 because the maximum tensile strength is equal to or greater than 600 MPa. The thickness of the center portion was set to 3.2 mm for the number 1 to number 7 golf club heads. The thickness was substantially 30% thinner than the 4.6 mm thickness of the number 12 golf club head that used 7075 aluminum alloy in its face member. Further, while the impact surface of the number 14 golf club head, which used stainless steel, was the thinnest from among the golf club heads 1 to 14 at 2.2 mm, the specific gravity was high at 7.8. Consequently, the mass was concentrated in the face portion of the golf club head, and the moment of inertia was small. Furthermore, the ratio of the golf club head mass to the golf club head volume for the number 13 golf club head that used a high strength aluminum alloy was 2.6, which does not fulfill the specification for the present invention that the ratio be equal to or greater than 3.0.

It should be noted that adjusting weight chips were provided in order to make the total mass of all of the golf club heads equal.

TABLE 1

| | Face Portion Member | Specific Gravity of Face Portion | Center Portion Thickness of Impact Surface (mm) | Maximum Tensile Strength of Face Portion Member (MPa) | Hosel Portion Member | Moment of Inertia (g · cm$^2$) | Center of Gravity Height (mm) | Center of Gravity Depth (mm) | Head Mass/ Head Volume (g/cm$^3$) | Specific Gravity of High Specific Gravity Metal |
|---|---|---|---|---|---|---|---|---|---|---|
| No. 1 | A | 2.9 | 3.2 | 680 | C | 2900 | 20 | 5 | 3.7 | 17.0 |
| No. 2 | A | 2.9 | 3.2 | 680 | C | 3200 | 18 | 7 | 7.8 | 17.0 |
| No. 3 | A | 2.9 | 3.2 | 680 | A | 3600 | 16 | 10 | 7.8 | 17.0 |
| No. 4 | A | 2.9 | 3.2 | 680 | C | 1800 | 20 | 9 | 3.0 | 17.0 |
| No. 5 | A | 2.9 | 3.2 | 680 | C | 1900 | 25 | 8 | 3.0 | 17.0 |
| No. 6 | A | 2.9 | 3.2 | 680 | C | 1930 | 25 | 1 | 3.0 | 17.0 |
| No. 7 | A | 2.9 | 3.2 | 680 | C | 1950 | 26 | 1 | 3.0 | — |
| No. 8 | B | 2.8 | 4.6 | 500 | C | 2250 | 22 | 3 | 7.7 | 17.0 |
| No. 9 | B | 2.8 | 4.6 | 500 | C | 1900 | 22 | 3 | 7.7 | — |
| No. 10 | B | 2.8 | 4.6 | 500 | C | 1800 | 22 | 8 | 2.4 | — |
| No. 11 | B | 2.8 | 4.6 | 500 | C | 1920 | 25 | 8 | 2.4 | — |
| No. 12 | B | 2.8 | 4.6 | 500 | C | 2200 | 23 | 3 | 7.8 | 17.0 |
| No. 13 | A | 2.9 | 3.2 | 680 | C | 2900 | 19 | 6 | 2.6 | 17.0 |
| No. 14 | C | 7.8 | 2.2 | 910 | C | 2000 | 23 | 2 | 7.8 | — |

A: High Strength Aluminum Alloy
B: 7075 Aluminum Alloy
C: Stainless Steel

Thirty golfers then test hitting 10 golf balls apiece using each 14 golf clubs that were provided with the golf club heads 1 to 14, respectively, and the feeling at impact, the golf ball carry distance, and the golf ball flight direction were investigated. Table 2 below shows results from the investigation. The results are indexed by taking the results of the number 14 golf club head as being equal to 100. The feeling at impact was given a number according to the sensory evaluation of the golfers. The higher the feeling at impact index, the softer the feeling at impact becomes. A softer feeling at impact is preferable for iron golf club heads. The higher the carry distance index, the greater the ball carry distance. Higher indexes for the flight direction characteristics mean that less dispersion was seen in the direction of the golf ball flight for the 10 ball impacts (the standard deviation was smaller). Further, a point total is also shown in which the indexes for the feeling at impact, the carry distance, and the flight direction characteristics are summed up together.

TABLE 2

| | Feeling at Impact | Carry Distance | Flight Direction Characteristics | Point Total |
|---|---|---|---|---|
| No. 1 | 105 | 106 | 104 | 315 |
| No. 2 | 106 | 112 | 111 | 329 |
| No. 3 | 116 | 118 | 119 | 353 |
| No. 4 | 106 | 115 | 103 | 324 |
| No. 5 | 106 | 109 | 104 | 319 |
| No. 6 | 106 | 107 | 105 | 318 |
| No. 7 | 104 | 105 | 105 | 314 |
| No. 8 | 95 | 101 | 101 | 297 |
| No. 9 | 94 | 98 | 101 | 293 |
| No. 10 | 92 | 94 | 100 | 286 |
| No. 11 | 90 | 92 | 101 | 283 |
| No. 12 | 101 | 102 | 101 | 304 |
| No. 13 | 104 | 103 | 93 | 300 |
| No. 14 | 100 (norm) | 100 (norm) | 100 (norm) | 300 |

The number 1 to number 7 golf club heads having a ratio of the head mass to the head volume equal to or greater than 3 g/cm$^3$, and in which the face portion that includes the impact surface is configured by a member made from an aluminum alloy having a maximum tensile strength equal to or greater than 600 MPa, each have a carry distance index equal to or greater than 104, and a total point value equal to or greater than 314. The total point value is extremely high compared to the maximum value of 304 from among the total point values of the number 8 to 14 golf club heads that do not pertain to the present invention. Furthermore, the flight direction characteristic index is equal to or greater than 103 for the number 1 to number 7 golf club heads, and the dispersion in the flight direction of the hit golf balls thus becomes smaller. In addition, the feeling at impact for the number 1 to number 7 golf club heads was softer due to the thinner impact surface.

The carry distance and the flight direction characteristics for the number 1 to number 4 golf club heads, in which the center of gravity height H is less than 23 mm and in which the center of gravity depth L is equal to or greater than 2 mm, is high compared to the number 8 to number 14 golf club heads.

On the other hand, even if a high strength aluminum alloy similar to that of the number 1 golf club head is used in the face portion of the number 13 golf club head, in which the ratio of the head mass to the head volume is less than 3 $g/cm^3$, and the moment of inertia is equal to or greater than 2,000 $g \cdot cm^2$, the carry distance, the flight direction characteristics, and the total number of points are inferior to those of the number 1 to number 7 golf club heads of the present invention. In particular, the flight direction characteristics and the total number of points are inferior.

It can thus be seen that even if the face portion is configured by using an aluminum alloy having a maximum tensile strength equal to or greater than 600 MPa, and the moment inertia is regulated to become higher by using an adjusting weight chip for a center of gravity of the golf club head, the carry distance and the flight direction characteristics do not improve unless the ratio of the head mass to the head volume is equal to or greater than 3.0 $g/cm^2$.

The golf club head of the present invention has a ratio of the head mass to the head volume for the golf club head equal to or greater than 3 $g/cm^3$, and the face portion including the impact surface is configured by using an aluminum alloy having a maximum tensile strenth equal to or greater than 600 MPa. It is thus clear that the golf club head of the present invention not only is preferable as an iron golf club head due to its carry distance and flight direction characteristics, but also due to its feeling at impact.

The golf club head of the present invention is explained in detail above. The present invention, however, is not limited to the embodiments described above. A variety of improvements and changes may of course be made in a range that does not deviate from the gist of the present invention.

What is claimed is:

1. A golf club head comprising:

a face portion including an impact surface that impacts a golf ball;

a sole portion;

a hosel portion into which a golf club shaft is inserted and fixed; and an adiusting member which is bonded to the sole portion of said golf club head in such a manner that the adjusting member and the sole portion contact a ground surface when the golf club is set in a position to address a golf ball, the adjusting member being made from a metal having a specific gravity equal to or greater than 8;

wherein a ratio of a head mass of said golf club head to a head volume of said golf club head is equal to or greater than 3 $g/cm^3$; and wherein said face portion including said impact surface is configured by using a member made from an aluminum alloy having a maximum tensile strength equal to or greater than 600 MPa, said aluminum alloy being made by using a rapid quenching method.

2. The golf club head according to claim 1, wherein, in addition to said face portion, said hosel portion is also configured by using said member made from an aluminum alloy.

3. The golf club head according to claim 1, wherein, when said golf club head is placed on a horizontal plane so as to achieve a specified loft angle, a moment of inertia about a vertical line that passes through a center of gravity of said golf club head and is orthogonal to said horizontal plane is equal to or greater than 2,000 $g \cdot cm^2$.

4. The golf club head according to claim 1, wherein a center of gravity height of said golf club head is less than 23 mm.

5. The golf club head according to claim 1, wherein a center of gravity position of said golf club head is set back from a leading edge of said impact surface by a distance equal to or greater than 2 mm in a direction opposite to golf ball impact direction.

6. A golf club head comprising:

a face portion including an impact surface that impacts a golf ball;

a sole portion;

a hosel portion into which a golf club shaft is inserted and fixed; and an adjusting member which is bonded to the sole portion of said golf club head in such a manner that the adjusting member and the sole portion contact a ground surface when the golf club is set in a position to address a ball, the adjusting member being made from a metal having a specific gravity equal to or greater than 8;

wherein a ratio of a head mass of said golf club head to a head volume of said golf club head is equal to or greater than 3 $g/cm^3$; and wherein said face portion including said impact surface is configured by a plate of 2.5 to 3.5 mm in thickness made from an aluminum alloy having a maximum tensile strength equal to or greater than 600 MPa, said aluminum alloy being made by using a rapid quenching method.

* * * * *